US010816212B2

(12) United States Patent
Hucker et al.

(10) Patent No.: US 10,816,212 B2
(45) Date of Patent: Oct. 27, 2020

(54) COMBUSTION CHAMBER HAVING A HOOK AND GROOVE CONNECTION

(71) Applicant: ROLLS-ROYCE plc, London (GB)

(72) Inventors: Paul A Hucker, Bristol (GB); Steven Ballantyne, Lenark (GB); Stephen C Harding, Bristol (GB)

(73) Assignee: ROLLS-ROYCE plc, London (GB)

( * ) Notice: Subject to any disclaimer, the term of this patent is extended or adjusted under 35 U.S.C. 154(b) by 612 days.

(21) Appl. No.: 15/467,603

(22) Filed: Mar. 23, 2017

(65) Prior Publication Data

US 2017/0307221 A1 Oct. 26, 2017

(30) Foreign Application Priority Data

Apr. 22, 2016 (GB) ..... 1607016.1

(51) Int. Cl.
*F23R 3/60* (2006.01)
*F23R 3/46* (2006.01)
(Continued)

(52) U.S. Cl.
CPC ..... *F23R 3/46* (2013.01); *F23R 3/002* (2013.01); *F23R 3/50* (2013.01); *F23R 3/60* (2013.01);
(Continued)

(58) Field of Classification Search
CPC .... F23R 3/60; F23R 3/002; F23R 3/50; F23R 2900/00005; F23R 2900/00017;
(Continued)

(56) References Cited

U.S. PATENT DOCUMENTS 5,297,932 A * 3/1994 Johnson ..... F01D 25/246 415/134
6,434,821 B1 8/2002 Nelson et al.
(Continued)

FOREIGN PATENT DOCUMENTS

| | | |
|---|---|---|
| EP | 3054218 A1 | 8/2016 |
| GB | 2 074 308 A | 10/1981 |
| GB | 2 432 902 A | 6/2007 |

OTHER PUBLICATIONS

Sep. 30, 2016 Search Report issued in British Patent Application No. 1607016.1.

(Continued)

*Primary Examiner* — William H Rodriguez
(74) *Attorney, Agent, or Firm* — Oliff PLC

(57) ABSTRACT

A gas turbine engine combustion chamber includes upstream and downstream ring structures and a plurality of circumferentially arranged combustion chamber segments. Each segment extends the full length of the combustion chamber and each segment is secured to the upstream ring structure and is mounted on the downstream ring structure. A frame structure at the downstream end of each segment has multiple spaced radially extending holes. The downstream end of each segment has an axially upstream extending groove and the downstream ring structure has an annular axially upstream extending hook which locates in the groove of each segment. A portion of the downstream ring structure abuts the frame structure of each segment. The downstream ring structure has multiple holes through the portion abutting the frame structure and segment is removably secured to the downstream ring structure by multiple fasteners locating in the holes in the segments and the downstream ring structure.

21 Claims, 12 Drawing Sheets

(51) Int. Cl.
*F23R 3/50* (2006.01)
*F23R 3/00* (2006.01)

(52) U.S. Cl.
CPC ..... *F23R 2900/00005* (2013.01); *F23R 2900/03041* (2013.01); *F23R 2900/03044* (2013.01)

(58) Field of Classification Search
CPC ..... F23R 3/46; F23R 2900/03044; F23R 2900/03041; F02C 7/20; F05D 2240/91
See application file for complete search history.

(56) References Cited

U.S. PATENT DOCUMENTS 6,513,330 B1 2/2003 Rice et al.
2002/0184891 A1* 12/2002 Conete ..... F23R 3/007 60/796
2002/0184892 A1* 12/2002 Calvez ..... F23R 3/007 60/796
2008/0010989 A1* 1/2008 Kato ..... F01D 9/023 60/752
2010/0037621 A1 2/2010 Tschuor et al.
2014/0190171 A1* 7/2014 Critchley ..... F23R 3/06 60/755
2015/0260405 A1 9/2015 Clemen
2016/0258624 A1* 9/2016 Harding ..... F23M 5/04
2017/0045227 A1* 2/2017 Harding ..... F23R 3/50
2018/0031238 A1* 2/2018 Harding ..... F23R 3/002
2018/0031242 A1* 2/2018 Harding ..... F23R 3/60
2018/0036843 A1* 2/2018 Hucker ..... F23R 3/002

OTHER PUBLICATIONS

Oct. 12, 2017 Search Report issued in European Patent Application No. 17162512.

* cited by examiner

COMBUSTION CHAMBER HAVING A HOOK AND GROOVE CONNECTION

The present disclosure relates to a combustion chamber and a combustion chamber segment and in particular to a gas turbine engine combustion chamber and a gas turbine engine combustion chamber segment.

A conventional annular combustion chamber comprises an annular radially inner wall and an annular radially outer wall secured to an annular upstream end wall. In the case of an annular combustion chamber mounted at its downstream end the annular radially outer wall is secured to an annular support member. The annular radially inner wall and the annular radially outer wall may be provided with tiles to protect the annular radially inner wall and the annular radially outer wall from the heat produced by the combustion process.

In operation a combustion chamber may be subjected to ultimate load situations, e.g. during compressor surge or combustion chamber flame out, when relatively high radial loads are exerted onto the combustion chamber.

It has been proposed to make the annular radially inner wall and the annular radially outer wall of an annular combustion chamber from combustion chamber segments. However, an annular combustion chamber comprising combustion chamber segments must be able to withstand the ultimate load situations. Therefore, these combustion chamber segments have been welded together and this negates some of the advantages of combustion chamber segments.

Therefore the present disclosure seeks to provide a novel combustion chamber and a novel combustion chamber segment which reduces or overcomes the above mentioned problem.

According to a first aspect of the invention there is provided combustion chamber comprising an upstream ring structure, a downstream ring structure and a plurality of circumferentially arranged combustion chamber segments, each combustion chamber segment extending the full length of the combustion chamber, each combustion chamber segment comprising a frame structure and an inner wall, the frame structure and the inner wall being integral, an upstream end of each combustion chamber segment being secured to the upstream ring structure and a downstream end of each combustion chamber segment being mounted on the downstream ring structure, wherein the downstream edge of the frame structure at the downstream end of each combustion chamber segment having a circumferentially and axially upstream extending groove, the downstream ring structure having an annular axially upstream extending hook locating in the axially upstream extending groove of each combustion chamber segment and the downstream ring structure having a portion abutting the surface of the frame structure at the downstream end of each combustion chamber segment, and each combustion chamber segment being removably secured to the downstream ring structure.

The frame structure at the downstream end of each combustion chamber segment may comprise a surface having a plurality of circumferentially spaced radially extending holes, the downstream ring structure having a plurality of circumferentially spaced holes extending radially through the portion abutting the surface of the frame structure and each combustion chamber segment being removably secured to the downstream ring structure by a plurality of fasteners locatable in the holes in the combustion chamber segment and corresponding holes in the downstream ring structure.

Each combustion chamber segment being removably secured to the downstream ring structure to allow differential thermal expansion and/or contraction between the combustion chamber segments and the downstream ring structure.

The combustion chamber may be an annular combustion chamber or a tubular combustion chamber.

The combustion chamber segments may form a radially outer annular wall of the annular combustion chamber.

The downstream ring structure abutting a radially outer surface of the frame structure, the downstream ring structure comprising at least one U or V shaped portion and an annular radially extending flange, the U or V shaped portion having a radially inner limb extending axially upstream from the portion abutting the radially outer surface of the frame structure, a bend and a radially outer limb extending axially downstream to the radially extending flange.

The downstream ring structure may comprise a plurality of circumferentially spaced U or V shaped portions and each U or V shaped portion having a radially inner limb extending axially upstream from the portion abutting the radially outer surface of the frame structure, a bend and a radially outer limb extending axially downstream to the radially extending flange.

The downstream ring structure may have an annular axially downstream extending member, the annular axially downstream extending member being arranged to form a seal with a radially outwardly extending flapper seal, the flapper seal being mounted at its radially inner end to a set of high pressure nozzle guide vanes.

The radially extending flange may be removably secured to a combustion chamber outer casing, for example by suitable fasteners, e.g. nuts and bolts.

The frame structure comprises a plurality of bosses and each boss has a corresponding one of the holes. There may be two bosses and two holes. The bosses may be provided at the corners of the frame structure.

The downstream ring structure may have a plurality of first holes and a plurality of second holes, the first and second holes being arranged circumferentially alternately around the downstream ring structure, each first hole has the same diameter as the diameter of the holes in the frame structure of the combustion chamber segments, each second hole is circumferentially slotted, each first hole is aligned axially and circumferentially with a hole in a corresponding combustion chamber segment and each second hole is aligned axially with another hole in the corresponding combustion chamber segment to allow relative circumferential thermal expansion between the combustion chamber segment and the downstream ring structure.

The combustion chamber segments may form a radially inner annular wall of the annular combustion chamber.

The downstream ring structure abutting a radially inner surface of the frame structure and the downstream ring structure comprising an annular radially inwardly extending flange.

The downstream ring structure may have an annular axially downstream extending member, the annular axially downstream extending member being arranged to form a seal with a radially inwardly extending flapper seal, the flapper seal being mounted at its radially outer end to a set of high pressure nozzle guide vanes.

The radially inwardly extending flange may be removably located in a radially extending groove on a combustion chamber inner casing.

The frame structure comprises a plurality of bosses and each boss has a corresponding one of the holes. There may be two bosses and two holes. The bosses may be provided at the corners of the frame structure.

The downstream ring structure may have a plurality of first holes and a plurality of second holes, the first and second holes being arranged circumferentially alternately around the downstream ring structure, each first hole has the same diameter as the diameter of the holes in the frame structure of the combustion chamber segments, each second hole is circumferentially slotted, each first hole is aligned axially and circumferentially with a hole in a corresponding combustion chamber segment and each second hole is aligned axially with another hole in the corresponding combustion chamber segment to allow relative circumferential thermal expansion between the combustion chamber segment and the downstream ring structure.

The frame structure of each combustion chamber segment may comprise a first end wall, a second end wall, a first edge wall and a second edge wall, the first and second end walls and the first and second edge walls are integral, the frame structure of each combustion chamber segment is radially thicker and stiffer than the inner wall, the first and second end walls are thicker axially than the radial thickness of the inner wall and the first and second edge walls are thicker circumferentially than the radial thickness of the inner wall in order to carry loads and interface with adjacent combustion chamber segments and the upstream ring structure and the downstream ring structure.

Each combustion chamber segment may have a first hole and a second hole, each first hole having the same diameter as the diameter of the holes in the downstream ring structure, each second hole being circumferentially slotted, each first hole being aligned axially and circumferentially with a corresponding hole in the downstream ring structure and each second hole being aligned axially with another corresponding hole in the downstream ring structure to allow relative circumferential thermal expansion between the combustion chamber segment and the downstream ring structure.

The downstream ring structure may have a plurality of first holes and a plurality of second holes, the first and second holes being arranged circumferentially alternately around the downstream ring structure, each first hole having the same diameter as the diameter of the holes in the frame structure of the combustion chamber segments, each second hole being circumferentially slotted, each first hole being aligned axially and circumferentially with a hole in a corresponding combustion chamber segment and each second hole being aligned axially with another hole in the corresponding combustion chamber segment to allow relative circumferential thermal expansion between the combustion chamber segment and the downstream ring structure.

Each combustion chamber segment may have a first hole associated with a corresponding hole in the downstream ring structure and each combustion chamber segment having a second hole associated with a corresponding hole in the downstream ring structure, the first hole of each combustion chamber segment having the same diameter as the corresponding hole in the downstream ring structure and one of the second hole of each combustion chamber segment and the corresponding hole in the downstream ring structure being circumferentially slotted, the first hole of each combustion chamber segment being aligned axially and circumferentially with the corresponding hole in the downstream ring structure and the second hole of each combustion chamber segment being aligned axially with the corresponding hole in the downstream ring structure to allow relative circumferential thermal expansion between the combustion chamber segment and the downstream ring structure.

The combustion chamber may be a gas turbine engine combustion chamber.

The gas turbine engine may be an aero gas turbine engine, a marine gas turbine engine, an industrial gas turbine engine or an automotive gas turbine engine.

The aero gas turbine engine may be a turbofan gas turbine engine, a turbojet gas turbine engine, a turbo propeller gas turbine engine or a turbo shaft gas turbine engine.

The skilled person will appreciate that except where mutually exclusive, a feature described in relation to any one of the above aspects of the invention may be applied mutatis mutandis to any other aspect of the invention.

Embodiments of the invention will now be described by way of example only, with reference to the Figures, in which.

Figure 1:
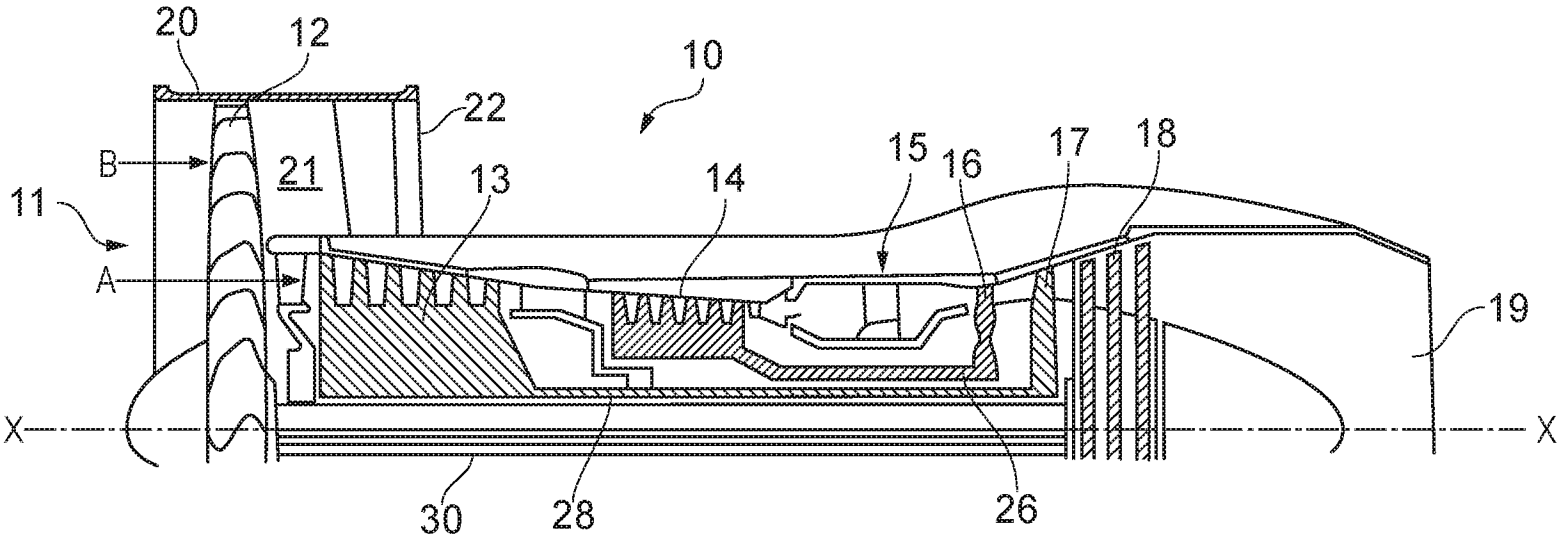
FIG. 1 is partially cut away view of a turbofan gas turbine engine having a combustion chamber comprising combustion chamber segments according to the present disclosure.

A turbofan gas turbine engine 10, as shown in FIG. 1, comprises in flow series an intake 11, a fan 12, an intermediate pressure compressor 13, a high pressure compressor 14, a combustion chamber 15, a high pressure turbine 16, an intermediate pressure turbine 17, a low pressure turbine 18 and an exhaust 19. The high pressure turbine 16 is arranged to drive the high pressure compressor 14 via a first shaft 26. The intermediate pressure turbine 17 is arranged to drive the intermediate pressure compressor 13 via a second shaft 28 and the low pressure turbine 18 is arranged to drive the fan 12 via a third shaft 30. The fan 12 is arranged within a fan casing 20 which defines a fan, or bypass, duct 21 and the fan duct 21 has a fan exhaust 22. In operation air flows into the intake 11 and is compressed by the fan 12. A first portion of the air A flows through, and is compressed by, the intermediate pressure compressor 13 and the high pressure compressor 14 and is supplied to the combustion chamber 15. Fuel is injected into the combustion chamber 15 and is burnt in the air to produce hot exhaust gases which flow through, and drive, the high pressure turbine 16, the intermediate pressure turbine 17 and the low pressure turbine 18. The hot exhaust gases leave the low pressure turbine 18 and flow through the exhaust 19 to provide propulsive thrust. A second portion of the air flow B bypasses the main engine and flows through the fan duct 21 and through the fan exhaust 22 to provide propulsive thrust.

Figure 2:
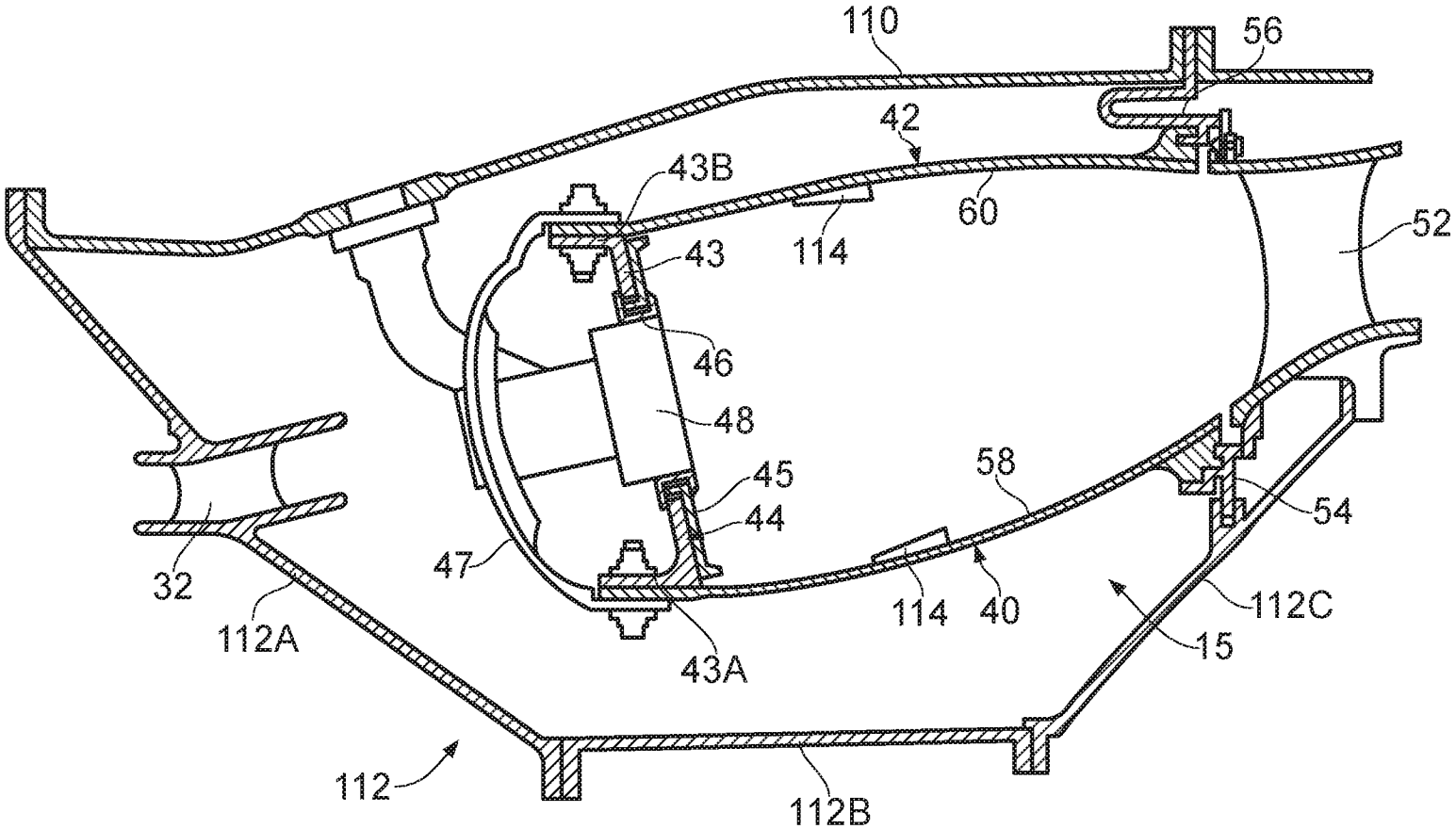
FIG. 2 is an enlarged cross-sectional view of a combustion chamber comprising combustion chamber segments according to the present disclosure.

The combustion chamber 15, as shown more clearly in FIG. 2, is an annular combustion chamber and comprises a radially inner annular wall structure 40, a radially outer annular wall structure 42 and an upstream end wall structure 44. The upstream end of the radially inner annular wall structure 40 is secured to the upstream end wall structure 44 and the upstream end of the radially outer annular wall structure 42 is secured to the upstream end wall structure 44. The upstream end wall structure 44 comprises an upstream end wall 43, a heat shield 45 and a cowl 47. The heat shield is positioned axially downstream of and secured to the upstream end wall 43 to protect the upstream end wall 43 from the combustion gases in the annular combustion chamber 15. The cowl 47 is positioned axially upstream of and secured to the upstream end wall 43. The combustion chamber 15 has a plurality of fuel injectors 48 and the fuel injectors 48 are arranged to supply fuel into the annular combustion chamber 15 during operation of the gas turbine engine 10. The upstream end wall 43 has a plurality of circumferentially spaced apertures 46 and each aperture 46 has a respective one of the plurality of fuel injectors 48 located therein. The heat shield 45 and the cowl 47 also each have a plurality of circumferentially spaced apertures and each aperture in the heat shield 45 and the cowl 47 is aligned with a corresponding aperture 46 in the upstream end wall 43. A plurality of circumferentially arranged compressor outlet guide vanes 32 are positioned axially upstream of the combustion chamber 15 and are arranged to direct the compressed air from the high pressure compressor 14 into the annular combustion chamber 15. A plurality of circumferentially arranged turbine nozzle guide vanes 52 are positioned axially downstream of the combustion chamber 15 and are arranged to direct the hot gases from the annular combustion chamber 15 into the high pressure turbine 16.

The annular combustion chamber 15 is positioned radially between a radially outer combustion chamber casing 110 and a radially inner combustion chamber casing 112. The radially inner combustion chamber casing 112 comprises a first, upstream, portion 112A, a second, intermediate, portion 112B and a third, downstream, portion 112C. The upstream end of the first portion 112A of the radially inner combustion chamber casing 112 is removably secured to the upstream end of the radially outer combustion chamber casing 110. In this example a flange at the upstream end of the first portion 112A of the radially inner combustion chamber casing 112 is removably secured to a flange at the upstream end of the radially outer combustion chamber casing 110 by suitable fasteners, e.g. nuts and bolts, passing through the flanges. The downstream end of the first portion 112A of the radially inner combustion chamber casing 112 is removably secured to the upstream end of the second portion 112B of the radially inner combustion chamber casing 112. In this example a flange at the upstream end of the second portion 112B of the radially inner combustion chamber casing 112 is removably secured to a flange at the downstream end of the first portion 112A of the radially inner combustion chamber casing 112 by suitable fasteners, e.g. nuts and bolts, passing through the flanges. The downstream end of the second portion 1126 of the radially inner combustion chamber casing 112 is removably secured to the upstream end of the third portion 112C of the radially inner combustion chamber casing 112 and the downstream end of the third portion 112C of the radially inner combustion chamber casing 112 is removably secured to the radially inner ends of the turbine nozzle guide vanes 52. In this example a flange at the upstream end of the third portion 112C of the radially inner combustion chamber casing 112 is removably secured to a flange at the downstream end of the second portion 112B of the radially inner combustion chamber casing 112 by nuts and bolts passing through the flanges and flanges on the turbine nozzle guide vanes 52 are removably secured to a flange at the downstream end of the third portion 112C of the radially inner combustion chamber casing 112 by nuts and bolts passing through the flanges.

The first portion 112A of the radially inner combustion chamber casing 112 is generally frustoconical and extends radially inwardly and axially downstream from its upstream end to the radially outer ends of the compressor outlet guide vanes 32 and extends radially inwardly and axially downstream from the radially inner ends of the compressor outlet guide vanes 32 to its downstream end. The second portion 112B of the radially inner combustion chamber casing 112 is generally cylindrical. The third portion 112C of the radially inner combustion casing 112 is generally frustoconical and extends radially outwardly and axially downstream from its upstream end to the radially inner ends of the turbine nozzle guide vanes 52.

The upstream end wall 43 has an inner annular flange 43A extending in an axially upstream direction therefrom and an outer annular flange 43B extending in an axially upstream direction therefrom. The upstream end wall 43 forms a radially inner upstream ring structure and a radially outer upstream ring structure. A radially inner downstream ring structure 54 is mounted off the radially inner combustion chamber casing 112 and a radially outer downstream ring structure 56 is mounted off the radially outer combustion chamber casing 110. The radially inner annular wall structure 40 of the annular combustion chamber 15 and the radially outer annular wall structure 42 of the annular combustion chamber 15 comprise a plurality of circumferentially arranged combustion chamber segments 58 and 60 respectively. It is to be noted that the combustion chamber segments 58, 60 extend the full axial, longitudinal, length of the annular combustion chamber 15.

Figure 3:
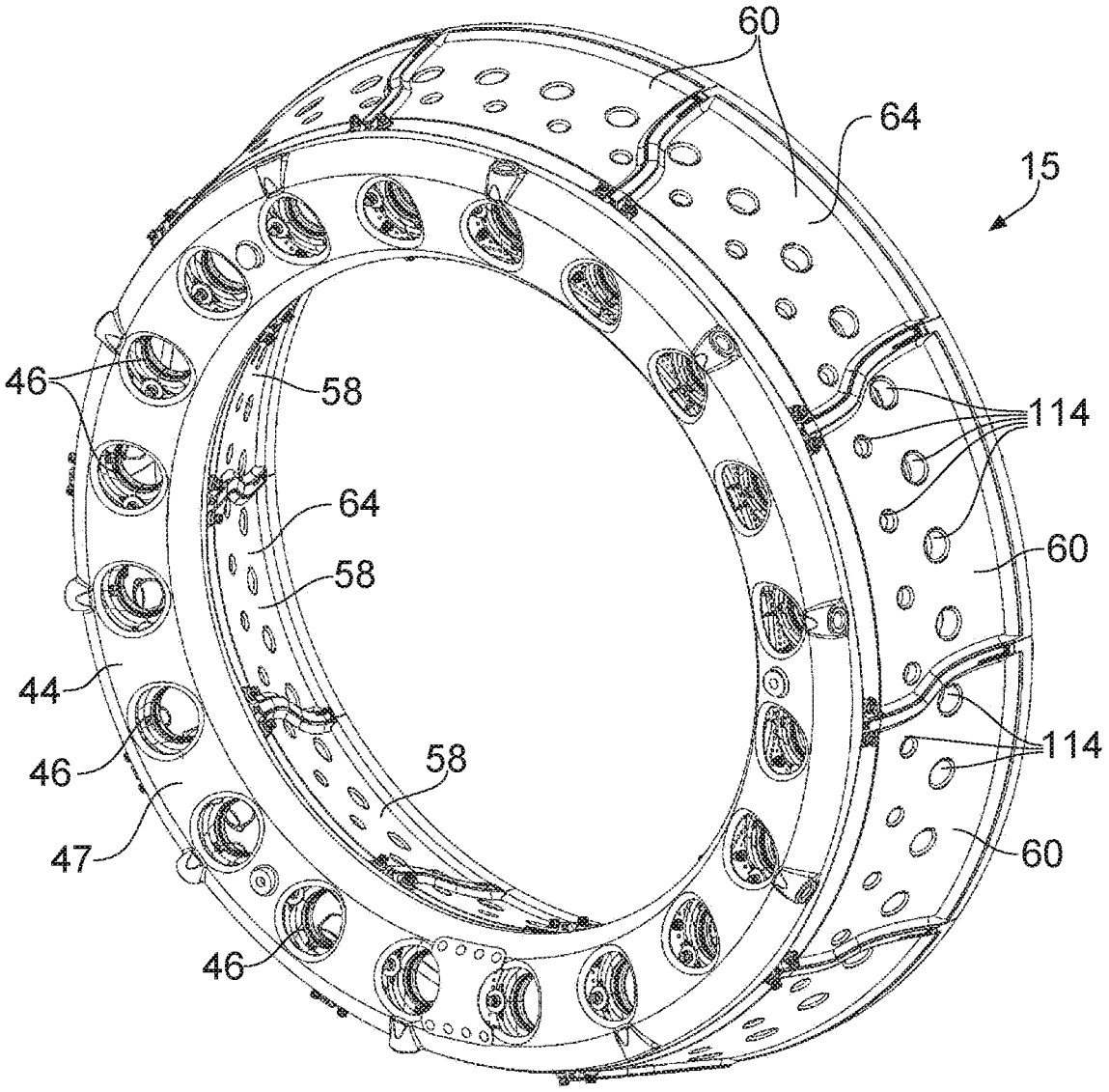
FIG. 3 is a perspective view of a combustion chamber comprising combustion chamber segments according to the present disclosure.

The circumferential arrangement of combustion chamber segments 58 and 60 of the radially inner and radially outer annular wall structures 40 and 42 of the annular combustion chamber 15 are clearly shown in FIG. 3. In this example there are ten combustion chamber segments 58 and ten combustion chamber segments 60 and each combustion chamber segment 58 and 60 extends through an angle of 36°. Other suitable numbers of combustion chamber segments 58 and 60 may be used, e.g. two, three, four, five, six, eight or twelve, and the number of combustion chamber segments 58 may be the same as or different to the number of combustion chamber segments 60. It is preferred that each of the combustion chamber segments extends through the same angle, but it may be possible to arrange the combustion chamber segments to extend through different angles.

Figure 4:
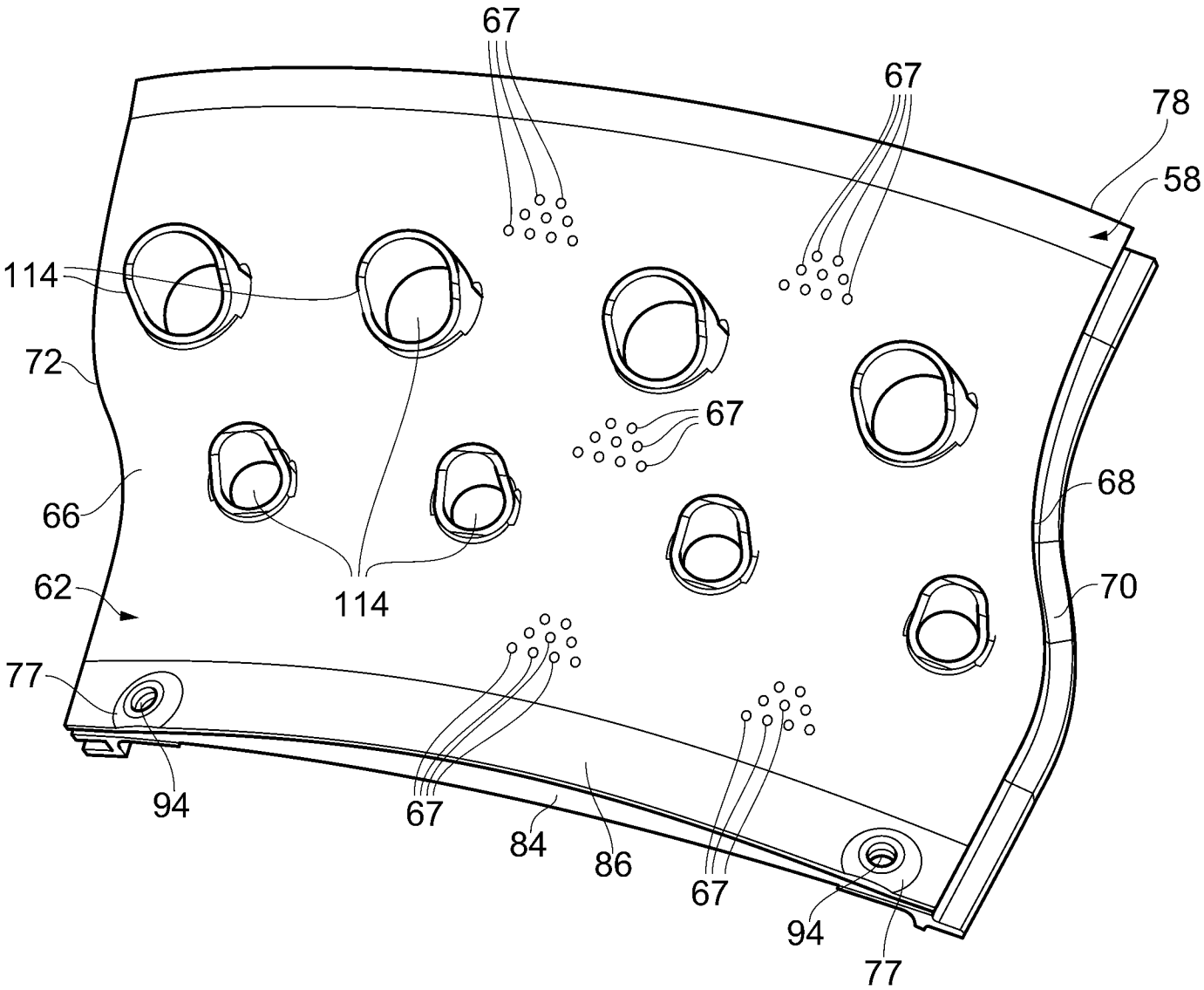
FIG. 4 is a further enlarged perspective view of a hot side of a combustion chamber segment shown in FIG. 3.
Figure 5:
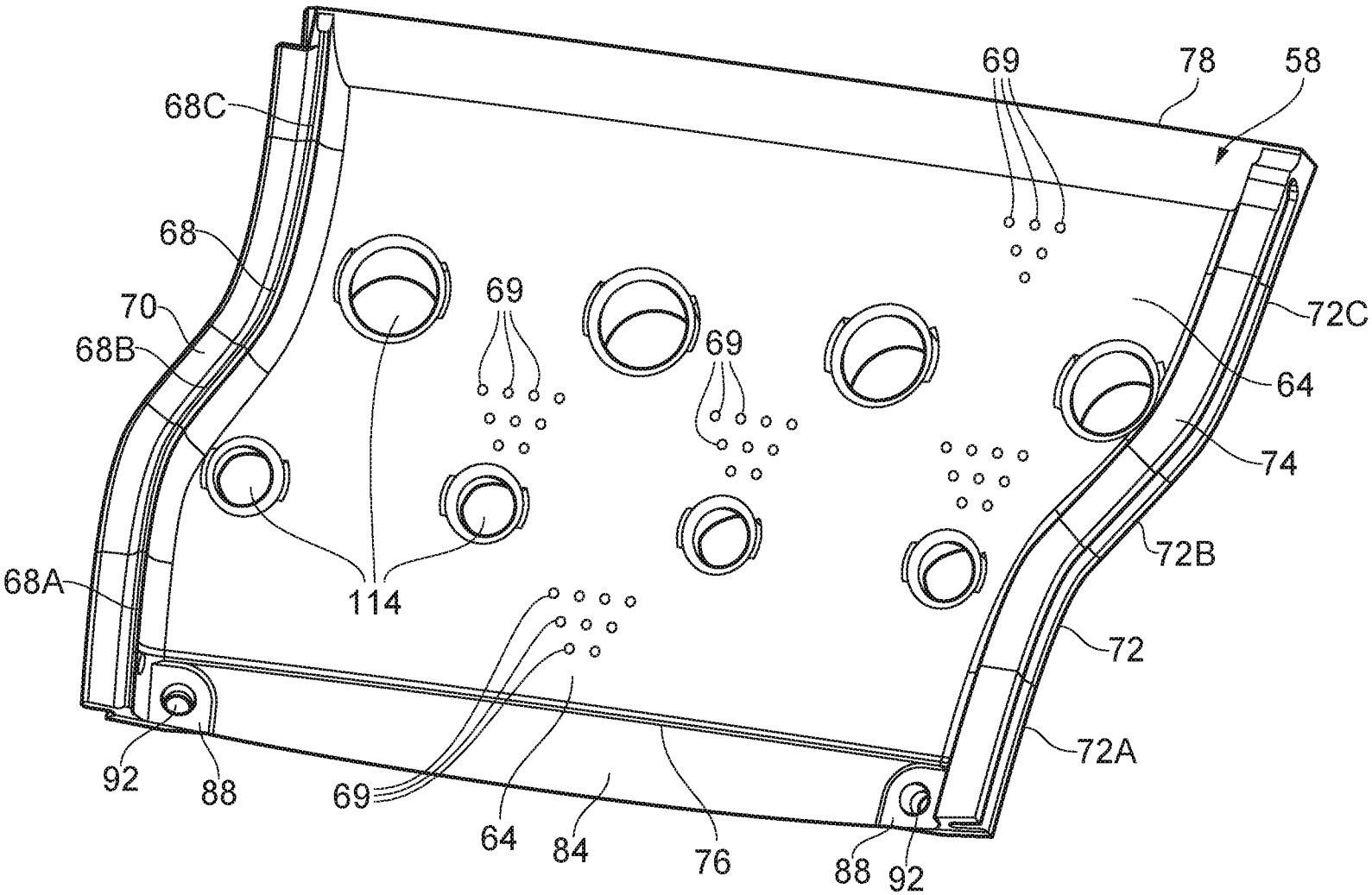
FIG. 5 is a further enlarged perspective view of a cold side of a combustion chamber segment shown in FIG. 3.
Figure 6:
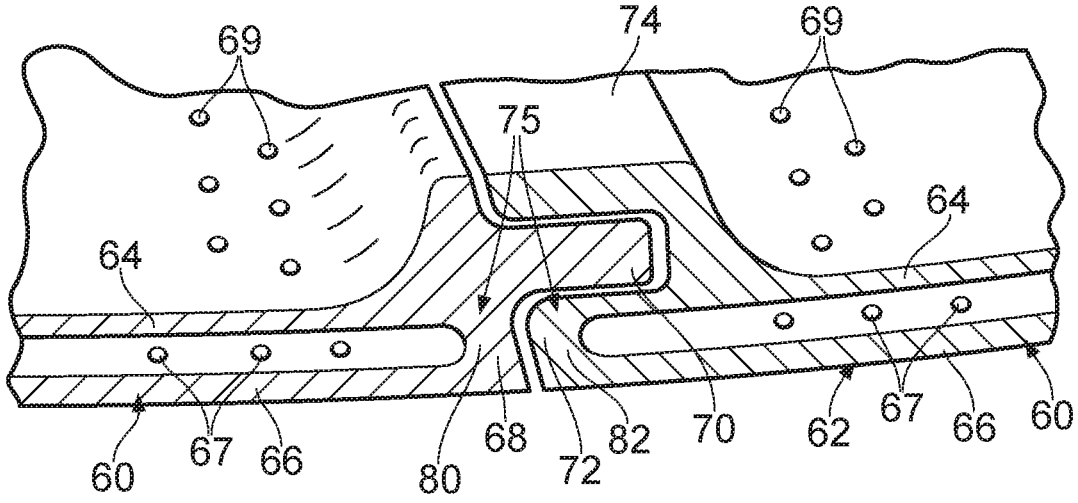
FIG. 6 is a further enlarged cross-sectional view through the portions of the edges of two adjacent combustion chamber segments shown in FIG. 3.

Each combustion chamber segment 58 and 60, as shown in FIGS. 4, 5 and 6, comprises a box like structure 62 including an outer wall 64 and an inner wall 66 spaced from the outer wall 64. The outer wall 64 and the inner wall 66 are arcuate. FIGS. 4, 5 and 6 show a combustion chamber segment 58 of the radially inner annular wall structure 40, but the combustion chamber segment 60 of the radially outer annular wall structure 42 are substantially the same as those of the radially inner annular wall structure 40. The outer wall 64 has a plurality of apertures 69 for the supply of coolant into the box like structure 62 and the inner wall 66 has a plurality of apertures 67 for the supply of coolant out of the box like structure 62. The inner wall 66 may include bosses 77 as shown in FIG. 4. A first edge 68 of the box like structure 62 has a first hook 70 extending from the outer wall 64 and away from the inner wall 66. The first hook 70 extends at least a portion of the axial, longitudinal, length of the box like structure 62 and the first hook 70 is arranged at a first radial distance from the outer wall 64. A second edge 72 of the box like structure 62 has a second hook 74 extending from the outer wall 64 and away from the inner wall 66. The second hook 74 extends at least a portion of the axial, longitudinal, length of the box like structure 62, the second hook 74 is arranged at a second radial distance from the outer wall 64 and the second radial distance is greater than the first radial distance. The first hook 70 of each combustion chamber segment 58, 60 engages the outer wall 64 at the second edge 72 of an adjacent combustion chamber segment 58, 60 and the second hook 74 of each combustion chamber segment 58, 60 engages the first hook 70 of an adjacent combustion chamber segment 58, 60 to form a seal and to distribute loads between the adjacent combustion chamber segments 58, 60 and to maintain a circular profile, shape, for the radially inner, or radially outer, annular wall structure 40 and 42 of the annular combustion chamber 15, e.g. to prevent dislocation of the combustion chamber segments 58, 60. Thus, the first hook 70 of each combustion chamber segment 58, 60 contacts, abuts, or is in close proximity to the surface of the outer wall 64 at the second edge 72 of the adjacent combustion chamber segment 58, 60 and the second hook 74 of each combustion chamber segment 58, 60 contacts, abuts, or is in close proximity to the surface of the first hook 70 at the first edge 68 of the adjacent combustion chamber segment 58, 60. The first hook 70 of each combustion chamber segment 60 is arranged radially outwardly of the outer wall 64 at the second edge 72 of the adjacent combustion chamber segment 60 and the second hook 74 of each combustion chamber 60 is arranged radially outwardly of the first hook 70 at the first edge 68 of the adjacent combustion chamber segment 60. Similarly, the first hook 70 of each combustion chamber segment 58 is arranged radially inwardly of the outer wall 64 at the second edge 72 of the adjacent combustion chamber segment 58 and the second hook 74 of each combustion chamber 58 is arranged radially inwardly of the first hook 70 at the first edge 68 of the adjacent combustion chamber segment 58.

The upstream end of each combustion chamber segment 58, 60 is secured, e.g. removably secured, to the upstream ring structure 43 and the downstream end of each combustion chamber segment 58, 60 is secured, e.g. removably secured, to the downstream ring structure 54, 56. Thus, the upstream end of each combustion chamber segment 58 is secured to the upstream ring structure, e.g. the upstream end wall, 43 and the downstream end of each combustion chamber segment 58 is secured to the radially inner downstream ring structure 54. Similarly, the upstream end of each combustion chamber segment 60 is secured to the upstream ring structure, e.g. the upstream end wall, 43 and the downstream end of each combustion chamber segment 60 is secured to the radially outer downstream ring structure 56.

The first hook 70 extends the length of the box like structure 62 between a securing arrangement and a mounting arrangement and the second hook 74 also extends the length of the box like structure 62 between the securing arrangement and the mounting arrangement. The securing arrangement and the mounting arrangement are discussed further below.

However, it may be possible for the first hook to extend the full length of the box like structure and for the second hook to extend the full length of the box like structure. Alternatively, it may be possible for the first hook to extend only a part of the full length of the box like structure and for the second hook to extend only a part of the full length of the box like structure. Additionally, it may be possible for there to be a plurality of first hooks arranged along the length of the box like structure and for there to be a number of second hooks arranged along the length of the box like structure.

The box like structure 62 of each combustion chamber segment 58, 60 has a first end wall 76 extending from a first, upstream, end of the outer wall 64 to a first, upstream, end of the inner wall 66, a second end wall 78 extending from a second, downstream and opposite, end of the outer wall 64 to a second, downstream and opposite, end of the inner wall 66. A first edge wall 80 extending from a first circumferential edge of the outer wall 64 to a first circumferential edge of the inner wall 66, a second edge wall 82 extending from a second, opposite circumferential, edge of the outer wall 64 to a second, opposite circumferential, edge of the inner wall 66 to form the box like structure 62.

The box like structure 62 of each combustion chamber segment 58, 60 comprises a frame 75. The frame 75 comprises the first and second end walls 76 and 78 and the first and second edge walls 80 and 82. The first and second end walls 76 and 78 and the first and second edge walls 80 and 82 are integral, e.g. one piece. The frame 75 of each combustion chamber segment 58, 60 is radially thicker, and stiffer, than the outer wall 64 and the inner wall 66 and the first and second end walls 76 and 78 and the first and second edge walls 80 and 82 are thicker axially and thicker circumferentially respectively than the radial thickness of the outer and inner walls 64 and 66 in order to carry loads and interface with adjacent combustion chamber segments 58, 60 and the upstream ring structure and the downstream ring structure. The frame 75 of each combustion chamber segment 58, 60 is arranged to carry the structural loads, the thermal loads, surge loads and flameout loads. The first hook 70 is provided on the first edge wall 80 and the second hook 74 is provided on the second edge wall 82. In other words the box like structure 62 of each combustion chamber segment 58, 60 comprises the frame 75 and portions of the outer and inner walls 64 and 66 extending axially, longitudinally, between the first and second end walls 76 and 78 and extending circumferentially, laterally, between the first and second edge walls 80 and 82. The outer wall 64 and the inner wall 66 are also integral with the frame 75, e.g. the outer wall 64, the inner wall 66 and the frame 75 are a single piece, a monolithic piece.

Each combustion chamber segment comprises an integral structure, e.g. a single piece or monolithic piece, formed by additive layer manufacturing. The apertures in the outer wall, the apertures in the inner wall and any structure or structures, e.g. cellular structure or pedestals, between the inner and outer wall are all formed by the additive layer manufacturing (ALM) process. The additive layer manufacturing process may be direct laser deposition (DLD), selective laser sintering, direct electron beam deposition, laser powder bed etc. The combustion chamber segments are built using the additive layer manufacturing by initially starting from the upstream end, or the downstream end, of the combustion chamber segment. The combustion chamber segment is built up layer by layer using additive layer manufacturing in the longitudinal, axial, direction of the wall which corresponds to the direction of flow of hot gases over the second surface of the wall.

Thus, the combustion chamber comprises an upstream ring structure, a downstream ring structure and a plurality of circumferentially arranged combustion chamber segments. Each combustion chamber segment extends the full axial, longitudinal, length of the combustion chamber.

Figure 7:
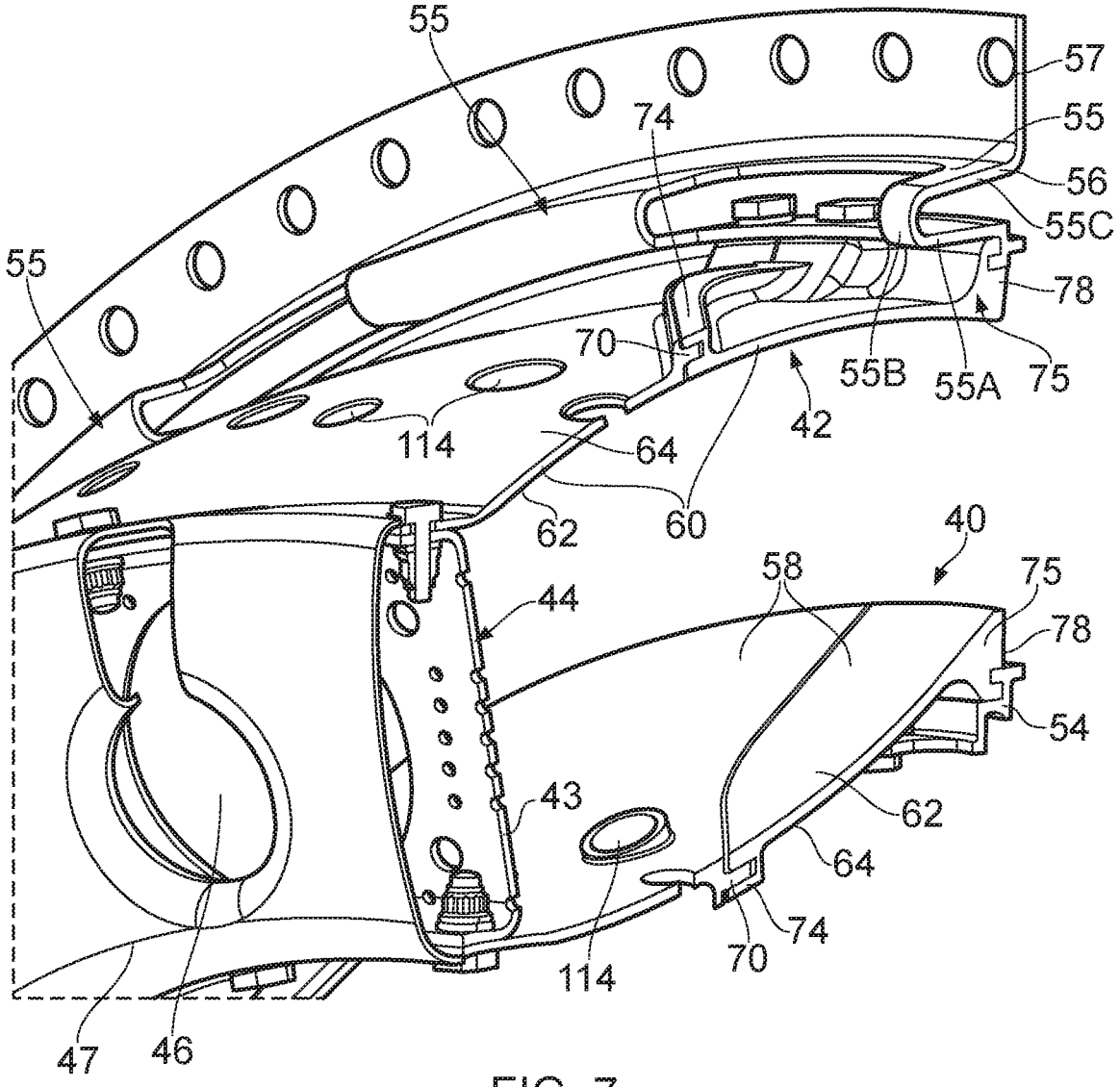
FIG. 7 is a further enlarged partially cut-away view perspective view showing the downstream end of the combustion chamber shown in FIG. 2.
Figure 8:
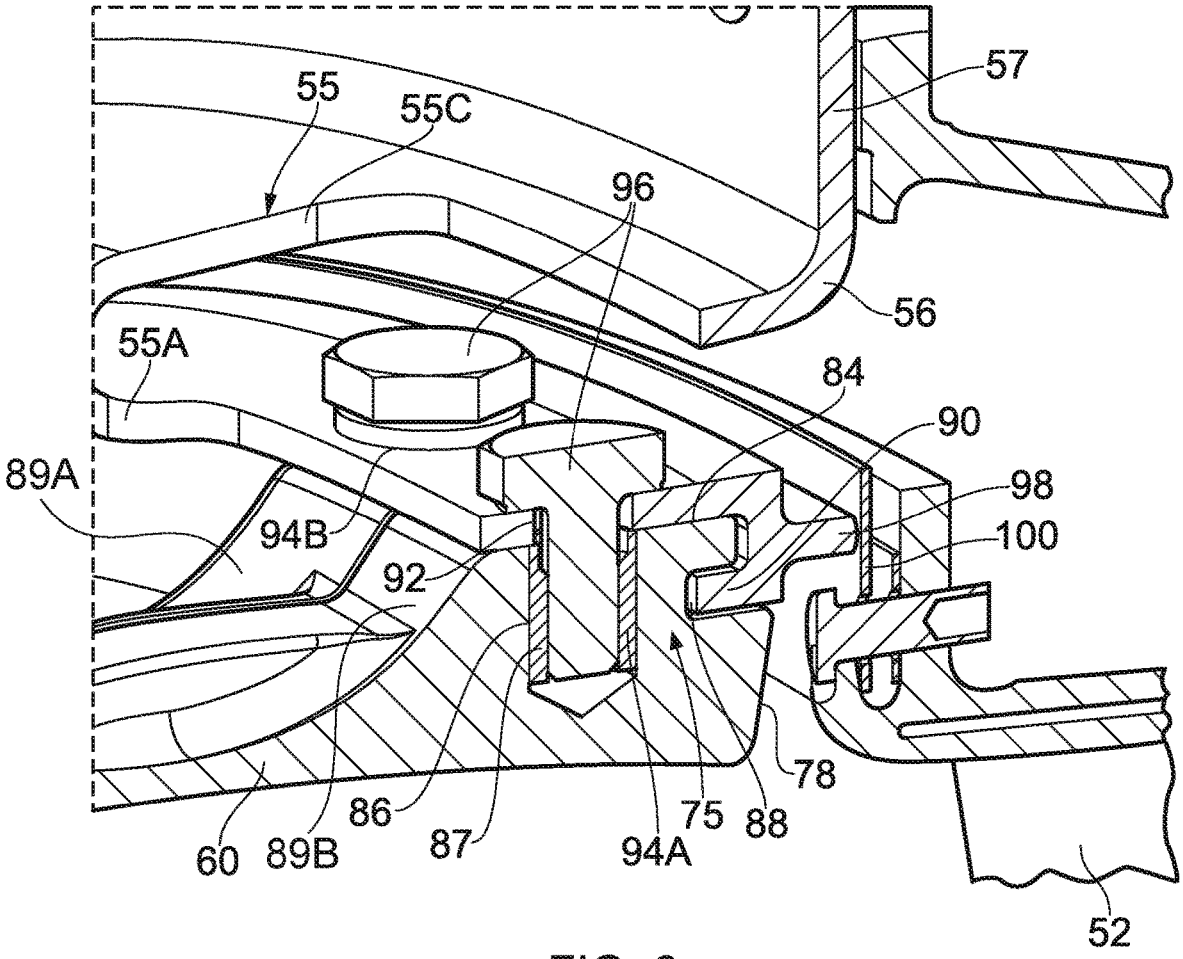
FIG. 8 is a further enlarged perspective view of the downstream end of the radially outer wall of the combustion chamber shown in FIG. 7.
Figure 9:
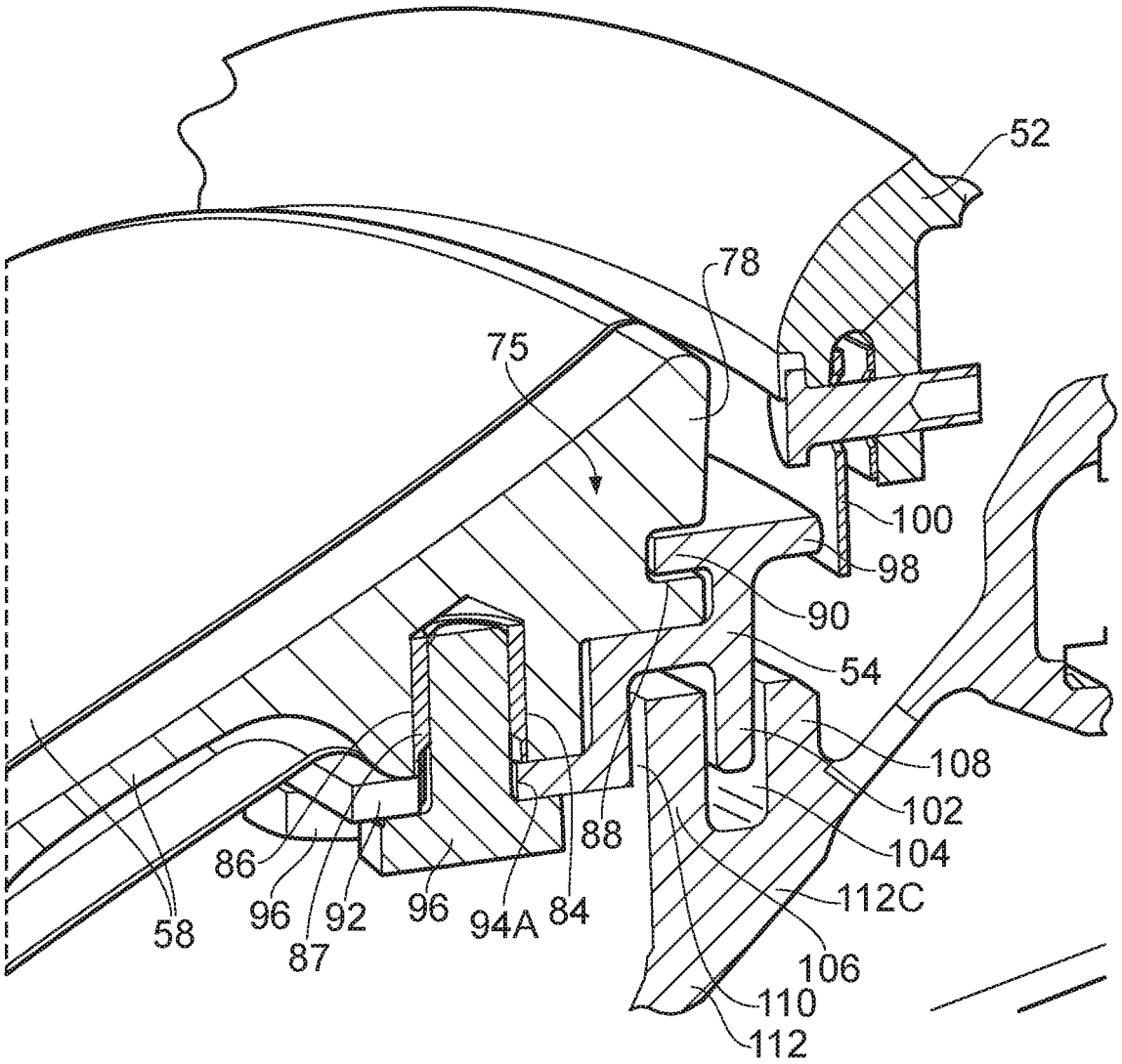
FIG. 9 is a further enlarged perspective view of the downstream end of the radially inner wall of the combustion chamber shown in FIG. 7.

FIGS. 7, 8 and 9 show the radially inner and radially outer downstream ring structures 54 and 56 and the downstream end walls 78 of the corresponding combustion chamber segments 58 and 60 in more detail. The frame structure 75 at the downstream end of each combustion chamber segment 58, 60 comprises a surface 84 having a plurality of circumferentially spaced radially extending bolt holes 86. The downstream edge of the frame structure 75 at the downstream end of each combustion chamber segment 58, 60 has a circumferentially and axially upstream extending groove 88, e.g. each combustion chamber segment 58, 60 has a circumferentially and axially upstream extending groove 88 provided in the downstream end wall 78. The corresponding downstream ring structure 54, 56 has an annular axially upstream extending hook 90 arranged to locate in the axially upstream extending groove 88 of each combustion chamber segment 58, 60 and the downstream ring structure 54, 56 has a portion 92 abutting the surface 84 of the frame structure 75 at the downstream end of each combustion chamber segment 58, 60. The downstream ring structure 54, 56 has a plurality of circumferentially spaced bolt holes 94 extending radially through the portion 92 abutting the surface 84 of the frame structure 75 of the combustion chamber segments 58 and 60. Each combustion chamber segment 58, 60 is removably secured to the corresponding downstream ring structure 54, 56 by a plurality of bolts 96 locatable in the bolt holes 86 in the combustion chamber segment 58, 60 and the corresponding bolt holes 94 in the corresponding downstream ring structure 54, 56. The downstream ring structure 54, 56 has an annular axially downstream extending member 98 and the annular axially downstream extending member 98 is arranged to form a seal with a radially extending flapper seal 100. The flapper seal 100 is mounted at one end to the high pressure nozzle guide vanes 52. The flapper seal 100 is a sprung strip of metal, which is arranged to push against the member 98.

FIG. 8 shows the radially outer downstream ring structure 56 in more detail and the radially outer downstream ring structure 56 abuts a radially outer surface 84 of the frame structure 75 of each combustion chamber segment 60. The radially outer downstream ring structure 56 comprises at least one U or V shaped portion 55 and an annular radially extending flange 57, each U or V shaped portion 55 has a radially inner limb 55A extending axially upstream from the portion 92 abutting the radially outer surface 84 of the frame structure 75, a bend 55B and a radially outer limb 55C extending axially downstream to the radially extending flange 57. In this example the radially outer downstream ring structure 56 comprises a plurality of circumferentially spaced U or V shaped portions 55 and each U or V shaped portion 55 has a radially inner limb 55A extending axially upstream from the portion 92 abutting the radially outer surface 84 of the frame structure 75, a bend 55B and a radially outer limb 55C extending axially downstream to the radially extending flange 57. The annular axially downstream extending member 98 is arranged to form a seal with a radially outwardly extending flapper seal 100 and the flapper seal 100 is mounted at its radially inner end to the high pressure nozzle guide vanes 52. The flapper seal 100 is a sprung strip of metal, which is arranged to push against the member 98. In this example there are ten U or V shaped portions 55, but more generally the number of U or V shaped portions 55 is the same as the number of combustion chamber segments 60.

The radially extending flange 57 is removably secured to the radially outer combustion chamber casing 110. The downstream end of the radially outer combustion chamber casing 110 is also removably secured to an upstream end of a turbine casing. In this example the radially extending flange 57 is removably secured to a flange at the downstream end of the radially outer combustion chamber casing 110 and a flange at the upstream end of the turbine casing by suitable fasteners, e.g. nuts and bolts.

The frame structure 75 comprises a plurality of bosses and each boss has a corresponding one of the bolt holes 86. In this example there are two bosses and two bolt holes 86 and the bosses are provided at the corners of the frame structure 75 at the downstream end of the combustion chamber segments 60. The bosses and the bolt holes 86 are arranged adjacent the downstream ends of the first and second edge walls 80 and 82.

The radially outer downstream ring structure 56 has a plurality of first bolt holes 94A and a plurality of second bolt holes 94B. The first and second bolt holes 94A and 94B are arranged circumferentially alternately around the radially outer downstream ring structure 56. Each first bolt hole 94A has substantially the same diameter as the diameter of the bolt holes 86 in the frame structure 75 of the combustion chamber segments 60, but each second bolt hole 94B is circumferentially slotted. Each first bolt hole 94A is aligned axially and circumferentially with a bolt hole 86 in a corresponding combustion chamber segment 60 to circumferentially position the combustion chamber segment 60 relative to the radially outer downstream ring structure 56 and each second bolt hole 94B is aligned axially with another bolt hole 86 in the corresponding combustion chamber segment 60 to allow relative circumferential thermal expansion between the combustion chamber segment 60 and the radially outer downstream ring structure 56. A washer may be used with each bolt 96 located in a second bolt hole 94B. The bolt holes 86 may be threaded or may be provided with threaded inserts 87.

Thus, in one particular arrangement each first bolt hole 94A is aligned with the bolt hole 86 in the boss adjacent the downstream end of the first edge wall 80 of a corresponding one of the combustion chamber segments 60 and each second bolt hole 94B is aligned with the bolt hole 86 in the boss adjacent the downstream end of the second edge wall 82 of a corresponding one of the combustion chamber segments 60.

The bolt holes 94 in the portion 92 of the radially outer downstream ring structure 56 are positioned circumferentially between adjacent U or V shaped portions 55 of the radially outer downstream ring structure 56. Additionally, the bolt holes 86 at the corners of the frames 75 of the combustion chamber segments 60 and the bolts 96 are also positioned circumferentially between adjacent U or V shaped portions 55 of the radially outer downstream ring structure 56. Thus, the edges of the combustion chamber segments at the downstream end of the combustion chamber segments 60 are positioned circumferentially between the U or V shaped portions 55 of the radially outer downstream ring structure 56.

Thus, it is to be noted that the radially outer downstream ring structure 56 is located radially around the downstream ends of the combustion chamber segments 60 and the radially outer downstream ring structure 56 abuts the radially outer surface 84 of the frame structure 75 of each combustion chamber segment 60. In addition the annular hook 90 on the radially outer downstream ring structure 56 locates in the grooves 88 at the downstream ends of the combustion chamber segments 60. These features provide radial restraint against radial outward movement of the combustion chamber segments 60.

FIG. 9 shows the radially inner downstream ring structure 54 in more detail and the radially inner downstream ring structure 54 abuts a radially inner surface 84 of the frame structure 75 of each combustion chamber segment 58. The radially inner downstream ring structure 54 comprises an annular radially inwardly extending flange 102. The radially inwardly extending flange 102 is removably located in a radially extending groove 104 on the radially inner combustion chamber casing 112. The annular radially extending groove 104 is defined between two annular radially outwardly extending flanges 106 and 108 on the radially inner combustion chamber casing 112. For example the radially extending groove 104 and the annular radially outwardly extending flanges 106 and 108 are provided on the downstream portion 112C of the radially inner combustion chamber casing 112. The radially outwardly extending flange 106 is arranged to locate in an annular radially outwardly extending groove 110 on the radially inner downstream ring structure 54.

The frame structure 75 comprises a plurality of bosses 89A and 89B and each boss has a corresponding one of the bolt holes 86. In this example there are two bosses and two bolt holes 86 and the bosses are provided at the corners of the frame structure 75 at the downstream end of the combustion chamber segments 58. The bosses and the bolt holes 86 are arranged adjacent the downstream ends of the first and second edge walls 80 and 82.

The radially inner downstream ring structure 54 has a plurality of first bolt holes 94A and a plurality of second bolt holes 94B. The first and second bolt holes 94A and 94B are arranged circumferentially alternately around the radially inner downstream ring structure 54. Each first bolt hole 94A has substantially the same diameter as the diameter of the bolt holes 86 in the frame structure 75 of the combustion chamber segments 58, but each second bolt hole 94B is circumferentially slotted. Each first bolt hole 94A is aligned axially and circumferentially with a bolt hole 86 in a corresponding combustion chamber segment 58 to circumferentially position the combustion chamber segment 58 relative to the radially inner downstream ring structure 54 and each second bolt hole 94B is aligned axially with another bolt hole 86 in the corresponding combustion chamber segment 58 to allow relative circumferential thermal expansion between the combustion chamber segment 58 and the radially inner downstream ring structure 54. A washer may be used with each bolt 96 located in a second bolt hole 94B. The bolt holes 86 may be threaded or may be provided with threaded inserts 87.

Thus, in one particular arrangement each first bolt hole 94A is aligned with the bolt hole 86 in the boss adjacent the downstream end of the first edge wall 80 of a corresponding one of the combustion chamber segments 58 and each second bolt hole 94B is aligned with the bolt hole 86 in the boss adjacent the downstream end of the second edge wall 82 of a corresponding one of the combustion chamber segments 58.

Thus, it is to be noted that the radially inner downstream ring structure 54 is located radially within the downstream ends of the combustion chamber segments 58 and the radially inner downstream ring structure 54 abuts the radially outer surface 84 of the frame structure 75 of each combustion chamber segment 58. In addition the annular hook 90 on the radially inner downstream ring structure 54 locates in the grooves 88 at the downstream ends of the combustion chamber segments 58. These features provide radial restraint against radial inward movement of the combustion chamber segments 60.

The radially inner and radially outer downstream ring structures 54 and 56 may be manufactured by forging a ring and then machining, for example turning, the forged ring.

The surfaces 84 of the frame 75 of the combustion chamber segments 58 and 60 and the portions 92 of the corresponding downstream ring structures 54 and 56 are arranged parallel to the axis of the annular combustion chamber 15. The grooves 88 in the frames 75 of the combustion chamber segments 58 and the hooks 90 of the corresponding downstream ring structures 54 and 56 are arranged parallel to the axis of the annular combustion chamber 15.

The combustion chamber segments 58 and 60 have dilution apertures 114 to supply air for mixing into the annular combustion chamber 15. However, if the annular combustion chamber 15 is a lean burn combustion chamber, the combustion chamber segments 58 and 60 do not require dilution apertures.

Figure 10:
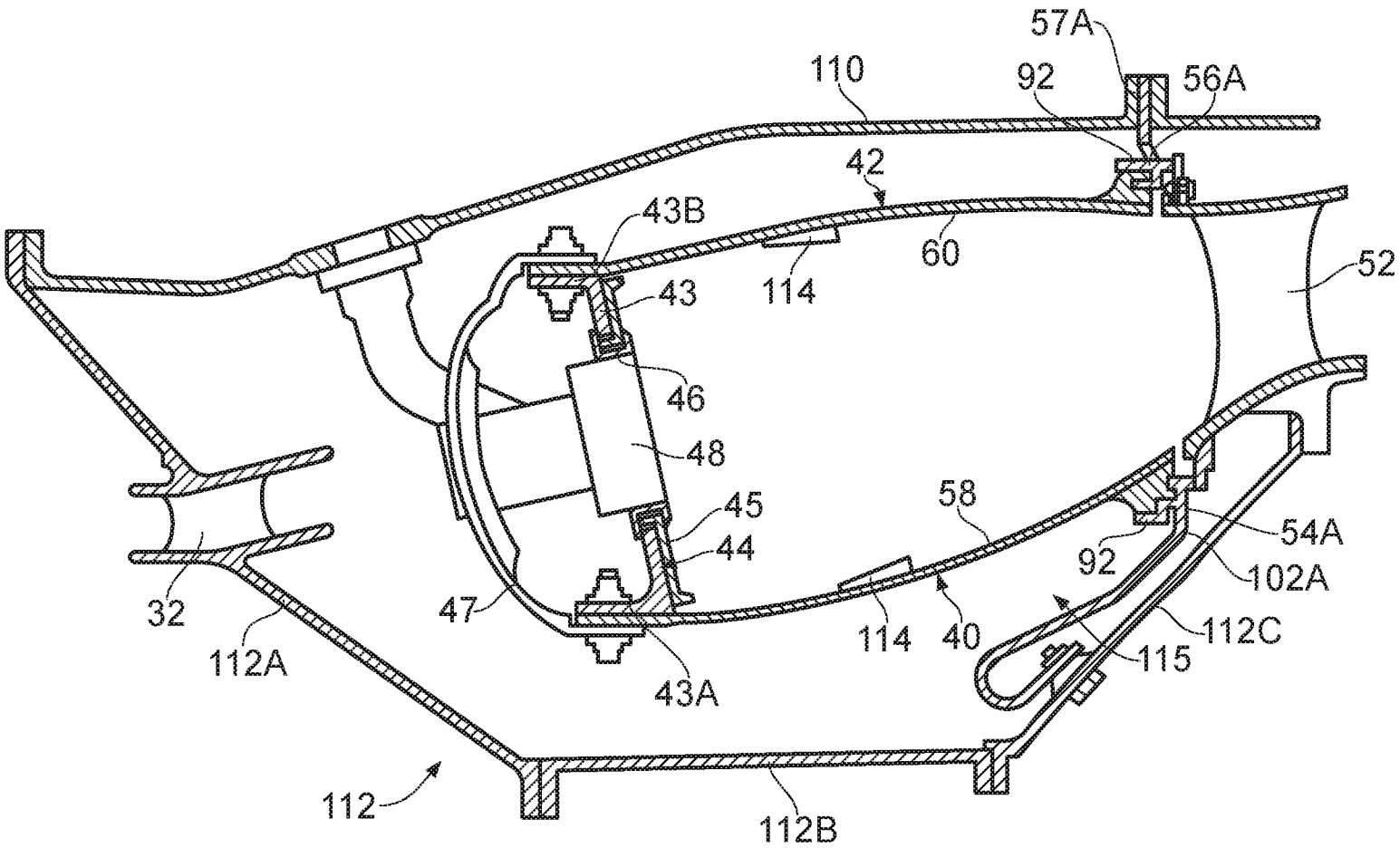
FIG. 10 is an enlarged cross-sectional view of a further combustion chamber comprising combustion chamber segments according to the present disclosure.

A further combustion chamber 115, as shown more clearly in FIG. 10, is an annular combustion chamber and this is substantially the same as that shown in FIGS. 2 to 9 and like parts are denoted by like numerals. The combustion chamber 115 differs in how the radially inner and radially outer downstream ring structures 54A and 56A are mounted to the radially inner combustion chamber casing 112 and the radially outer combustion chamber casing 110 respectively. The radially inwardly extending flange 102A of the radially inner downstream ring structure 54A extends in an upstream direction and has a U shaped bend and is removably secured to the downstream portion 112C of the radially inner combustion chamber casing 112 by removable fasteners, e.g. nuts and bolts. The radially outer downstream ring structures 56A has a radially outwardly extending flange 57A arranged at the downstream end of the portion 92 abutting the surface 84 of the frame structure 75 at the downstream end of each combustion chamber segment 60. The flange 57A may extend purely radially or may have a slight bend. The flange 57A is removably secured to the radially outer combustion chamber casing 110 by removable fasteners, e.g. nuts and bolts.

Figure 11:
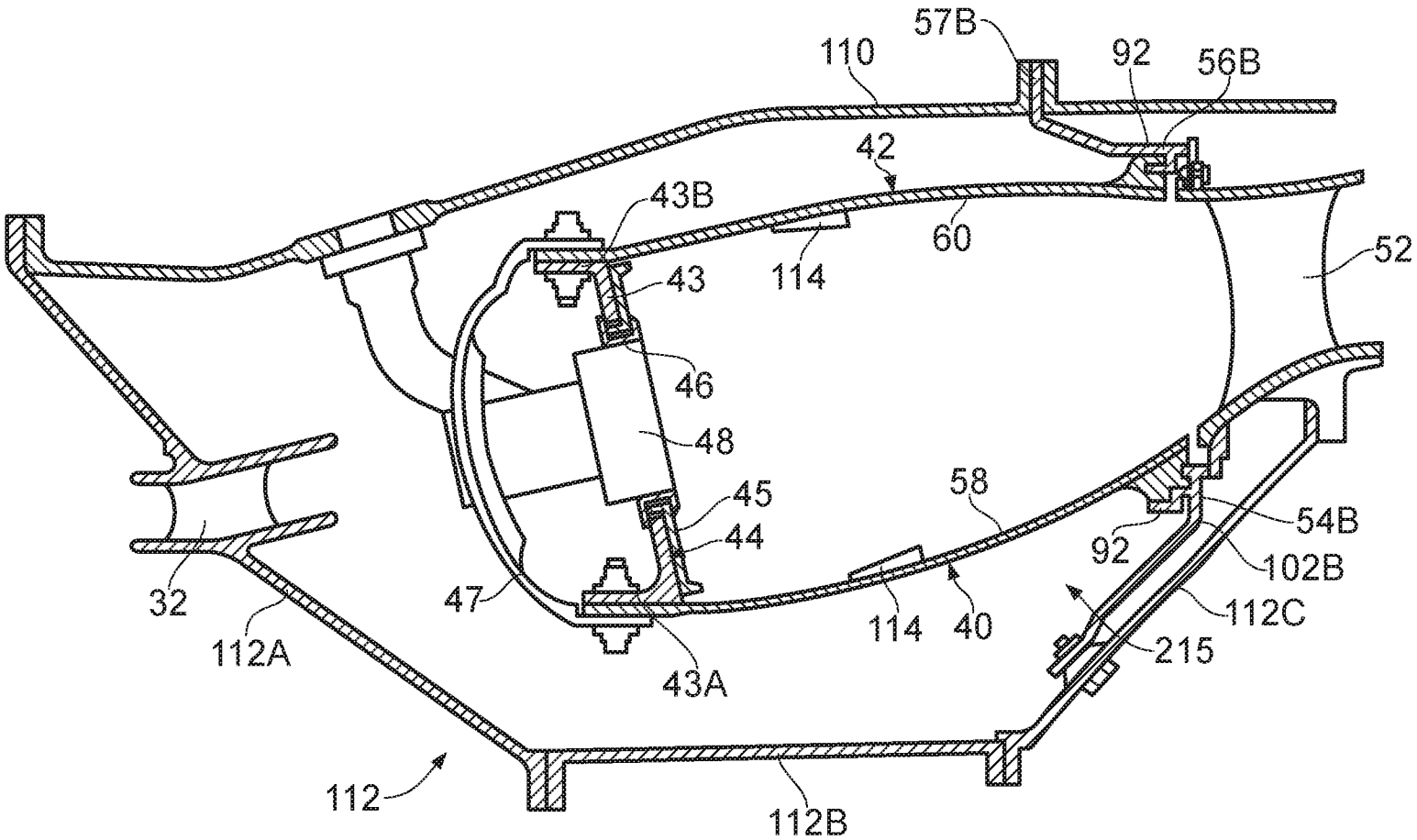
FIG. 11 is an enlarged cross-sectional view of another combustion chamber comprising combustion chamber segments according to the present disclosure.

Another combustion chamber 215, as shown more clearly in FIG. 11, is an annular combustion chamber and this is substantially the same as that shown in FIGS. 2 to 9 and like parts are denoted by like numerals. The combustion chamber 215 differs in how the radially inner and radially outer downstream ring structures 54B and 56B are mounted to the radially inner combustion chamber casing 112 and the radially outer combustion chamber casing 110 respectively.

The radially inwardly extending flange 102B of the radially inner downstream ring structure 54B extends in an upstream direction and is removably secured to the downstream portion 112C of the radially inner combustion chamber casing 112 by removable fasteners, e.g. nuts and bolts. The radially outer downstream ring structures 56B has a conical portion extending in an upstream direction from the upstream end of the portion 92 abutting the surface 84 of the frame structure 75 at the downstream end of each combustion chamber segment 60. The conical portion terminates in a flange 57B. The flange 57B is removably secured to the radially outer combustion chamber casing 110 by removable fasteners, e.g. nuts and bolts.

Figure 12:
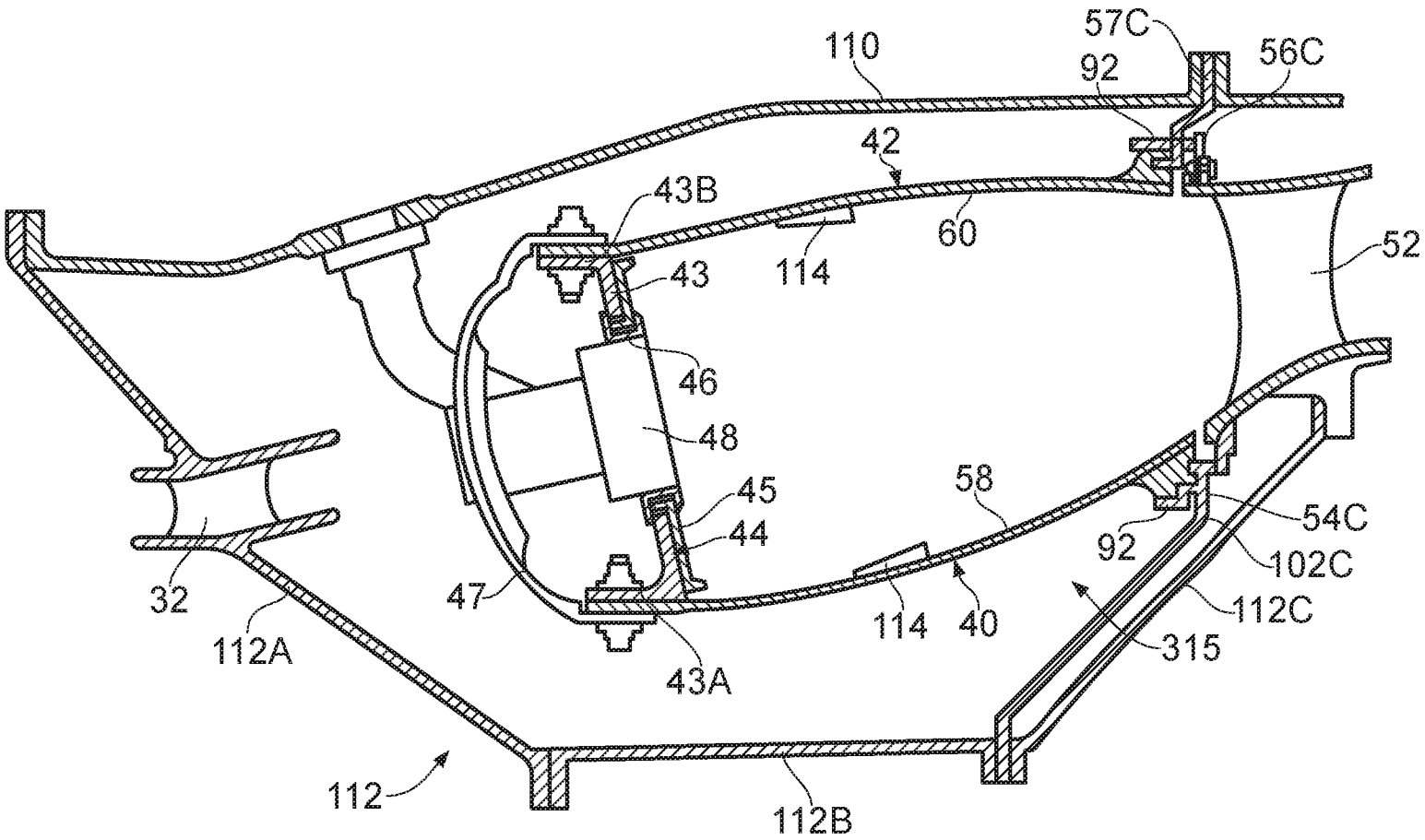
FIG. 12 is an enlarged cross-sectional view of an additional combustion chamber comprising combustion chamber segments according to the present disclosure.

An additional combustion chamber 315, as shown more clearly in FIG. 12, is an annular combustion chamber and this is substantially the same as that shown in FIGS. 2 to 9 and like parts are denoted by like numerals. The combustion chamber 315 differs in how the radially inner and radially outer downstream ring structures 54C and 56C are mounted to the radially inner combustion chamber casing 112 and the radially outer combustion chamber casing 110 respectively. The radially inwardly extending flange 102C of the radially inner downstream ring structure 54C has a conical portion which extends in an upstream direction to a further flange which is removably secured between the intermediate portion 112B and the downstream portion 112C of the radially inner combustion chamber casing 112 by removable fasteners, e.g. nuts and bolts. The radially outer downstream ring structures 56C has a conical portion extending in an downstream direction from the downstream end of the portion 92 abutting the surface 84 of the frame structure 75 at the downstream end of each combustion chamber segment 60. The conical portion terminates in a flange 57C. The flange 57C is removably secured to the radially outer combustion chamber casing 110 by removable fasteners, e.g. nuts and bolts.

It may be possible to combine the radially outer downstream ring structure shown in FIGS. 2 to 9 with the radially inner downstream ring structure shown in FIG. 10, FIG. 11 or FIG. 12. Similarly, it may be possible to combine the radially inner downstream ring structure shown in FIGS. 2 to 9 with the radially outer downstream ring structure shown in FIG. 10, FIG. 11 or FIG. 12. It may be possible to combine the radially outer downstream ring structure shown in FIG. 10 with the radially inner downstream ring structure shown in FIG. 11 or FIG. 12. Similarly, it may be possible to combine the radially inner downstream ring structure shown in FIG. 10 with the radially outer downstream ring structure shown in FIG. 11 or FIG. 12. It may be possible to combine the radially outer downstream ring structure shown in FIG. 11 with the radially inner downstream ring structure shown in FIG. 12. Similarly, it may be possible to combine the radially inner downstream ring structure shown in FIG. 11 with the radially outer downstream ring structure shown in FIG. 12.

The edges of the combustion chamber segments are S shaped, but may be W shaped or straight, e.g. the edges of the combustion chamber segments may extend with a purely axial component from the upstream end to the downstream end of the combustion chamber segment or the edges of the combustion chamber segments may extend with axial and circumferential component from the upstream end to the downstream end of the combustion chamber segment.

The apertures 69 in the outer wall 64 provide impingement cooling of the inner wall 66 and that the apertures 67 in the inner wall 66 provide effusion cooling of the inner wall 66. The effusion cooling apertures 67 may be angled at an acute angle to the inner surface of the inner wall 66 and apertures 67 may be fan shaped. Other cooling arrangements may be possible for the combustion chamber segments 58 and 60, e.g. a cellular structure may be provided between the inner and outer walls.

An advantage of the present disclosure is that there is a relatively large surface area of engagement between the radially inner downstream ring structure and the combustion chamber segments forming the radially inner annular wall of the annular combustion chamber and there is a relatively large surface area of engagement between the radially outer downstream ring structure and the combustion chamber segments forming the radially outer annular wall of the annular combustion chamber to provide radial restraint of the combustion chamber segments. This is of particular advantage during ultimate load situations, e.g. during compressor surge or combustion chamber flame out, when relatively high radial loads are exerted onto the combustion chamber segments tending to force the combustion chamber segments of the radially outer annular wall of the annular combustion chamber radially outwardly and to force the combustion chamber segments of the radially inner annular wall of the annular combustion chamber radially inwardly.

Another advantage of the present disclosure is that it allows for differential thermal expansion and/or contraction between the combustion chamber segments and the corresponding downstream ring structure without inducing relatively stresses in the combustion chamber segments and/or the corresponding downstream ring structure.

A further benefit is that the combustion chamber loads are transmitted into the frame structure of the combustion chamber segments and not into the inner wall and/or outer wall of the combustion chamber segments.

An additional benefit is that the combustion chamber segments are removably secured to the corresponding downstream ring structure which allows the combustion chamber segments to be repaired, or replaced. Thus, the combustion chamber segments may have a shorter working life than the corresponding downstream ring structure.

Another advantage of the present disclosure is that the combustion chamber segments are mounted at their downstream ends to the downstream ring structure and this reduces the amount of cooling air required to cool mounting features and this may result in more air being available for mixing with fuel in the combustion chamber and/or more air for cooling the nozzle guide vane platforms.

Although the present disclosure has referred to an annular combustion chamber in which combustion chamber segments form a radially outer annular wall and combustion chamber segments form a radially inner annular it is equally applicable to an annular combustion chamber in which combustion chamber segments only form a radially outer annular wall or to an annular combustion chamber in which combustion chamber segments only form a radially inner annular wall.

Although the present disclosure has referred to combustion chamber segments comprising an integral frame, an inner wall and an outer wall it is equally possible for the combustion chamber segments to comprise an integral frame and an inner wall.

Although the present disclosure has referred to an annular combustion chamber in which combustion chamber segments form a radially outer annular wall and combustion chamber segments form a radially inner annular it is equally applicable to a tubular combustion chamber.

Although the present disclosure has referred to providing bolt holes in the frame at the downstream ends of the combustion chamber segments with the same diameter and two sets of apertures in the associated downstream ring structure in which the holes of the first and second holes are arranged circumferentially alternatively around the ring and in which the bolt holes of one set have the same diameter as the bolt holes in the combustion chamber segments and the bolt holes of the other set are circumferentially slotted, it is equally possible to have the opposite arrangement. In the opposite arrangement all the bolt holes in the downstream ring structure have same diameter and each combustion chamber segment has a first bolt hole and a second bolt hole in the frame structure of the combustion chamber segment and each first bolt hole has the same diameter as the diameter of the bolt holes in the downstream ring structure and each second bolt hole is circumferentially slotted.

Although the present disclosure has referred to bolt holes in the frame at the downstream ends of the combustion chamber segments with the same diameter and two sets of apertures in the associated downstream ring structure in which the holes of the first and second holes are arranged circumferentially alternatively around the ring and in which the bolt holes of one set have the same diameter as the bolt holes in the combustion chamber segments and the bolt holes of the other set are circumferentially slotted, it is equally possible that each combustion chamber segment has a first bolt hole in the frame at the downstream end of the combustion chamber segment and each first bolt hole has the same diameter as a corresponding bolt hole in the downstream ring structure and each combustion chamber segment has a second bolt hole in the frame at the downstream end of the combustion chamber segment and each second bolt hole has a corresponding circumferentially slotted bolt hole in the downstream ring structure and the first and second bolt holes may have the same or different diameters. It is equally possible that each combustion chamber segment has a first bolt hole in the frame at the downstream end of the combustion chamber segment and each first bolt hole has the same diameter as a corresponding bolt hole in the downstream ring structure and each combustion chamber segment has a second circumferentially slotted bolt hole in the frame at the downstream end of the combustion chamber segment and each second bolt hole has a corresponding bolt hole in the downstream ring structure and the first bolt hole and the bolt hole corresponding to the second circumferentially slotted bolt hole may have the same or different diameters.

Generally each combustion chamber segment has a first hole associated with a corresponding hole in the downstream ring structure and each combustion chamber segment has a second hole associated with a corresponding hole in the downstream ring structure, the first hole of each combustion chamber segment has the same diameter as the corresponding hole in the downstream ring structure and one of the second hole of each combustion chamber segment and the corresponding hole in the downstream ring structure is circumferentially slotted, the first hole of each combustion chamber segment is aligned axially and circumferentially with the corresponding hole in the downstream ring structure and the second hole of each combustion chamber segment is aligned axially with the corresponding hole in the downstream ring structure to allow relative circumferential thermal expansion between the combustion chamber segment and the downstream ring structure.

Although the description has referred to the use of bolts and threaded holes or bolts and threaded inserts to removably secure the combustion chamber segments to the radially inner and radially outer downstream ring structures other suitable fasteners may be used, e.g. nuts and bolts, screws, pins and clips. Although the description has referred to the use of nuts and bolts to removably secure the radially inner and radially outer downstream ring structures to the inner and outer combustion chamber casings other suitable fasteners may be used, e.g. bolts and threaded holes, bolts and threaded inserts, screws, pins and clips.

The combustion chamber may be a gas turbine engine combustion chamber.

The gas turbine engine may be an aero gas turbine engine, a marine gas turbine engine, an industrial gas turbine engine or an automotive gas turbine engine.

The aero gas turbine engine may be a turbofan gas turbine engine, a turbojet gas turbine engine, a turbo propeller gas turbine engine or a turbo shaft gas turbine engine.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A combustion chamber comprising an upstream ring structure, a downstream ring structure and a plurality of circumferentially arranged combustion chamber segments, the combustion chamber having an axial direction that extends axially between the upstream ring structure and the downstream ring structure, each combustion chamber segment extending along a full length of the combustion chamber, each combustion chamber segment comprising a frame structure and an inner wall, the frame structure and the inner wall being integral, each combustion chamber segment and each frame structure having an upstream end and a downstream end, the downstream end of the frame structure of each combustion chamber segment having a downstream edge and a surface, the upstream end of each combustion chamber segment being secured to the upstream ring structure and the downstream end of each combustion chamber segment being mounted on the downstream ring structure, the downstream edge of the frame structure at the downstream end of each combustion chamber segment having a circumferentially and axially upstream extending groove, the downstream ring structure having an annular axially upstream extending hook disposed in the axially upstream extending groove of each combustion chamber segment such that the hook is inserted into the groove along the axial direction, the downstream ring structure having a portion abutting the surface of the frame structure at the downstream end of each combustion chamber segment, the surface at the downstream end of the frame structure of each combustion chamber segment having a plurality of circumferentially spaced radially extending holes, the downstream ring structure having a plurality of circumferentially spaced holes extending radially through the portion abutting the surface of the frame structure, and each combustion chamber segment being removably secured to the downstream ring structure by a plurality of fasteners locatable in the holes in the frame structure and corresponding holes in the downstream ring structure, each combustion chamber segment being removably secured to the downstream ring structure to allow differential thermal expansion and/or contraction between the combustion chamber segments and the downstream ring structure.

2. A combustion chamber as claimed in claim 1 wherein the downstream ring structure has a plurality of first holes and a plurality of second holes, the first holes and the second holes being arranged circumferentially and alternately around the downstream ring structure, each first hole has a same diameter as a diameter of the holes in the frame structure of the combustion chamber segments, each second hole is circumferentially slotted, each first hole is aligned axially and circumferentially with a hole in a corresponding combustion chamber segment and each second hole is aligned axially with another hole in the corresponding combustion chamber segment to allow relative circumferential thermal expansion between each combustion chamber segment and the downstream ring structure.

3. A combustion chamber as claimed in claim 2 wherein the combustion chamber is an annular combustion chamber or a tubular combustion chamber.

4. A combustion chamber as claimed in claim 3 wherein the combustion chamber segments form a radially outer annular wall of the annular combustion chamber.

5. A combustion chamber as claimed in claim 4 wherein:

the downstream ring structure abutting a radially outer surface of the frame structure, the downstream ring structure comprises at least one U or V shaped portion and an annular radially extending flange, the U or the V shaped portion having a radially inner limb extending axially upstream from the portion abutting the radially outer surface of the frame structure, a bend and a radially outer limb extending axially downstream to the radially extending flange, and the U or V shaped portion has a cutout section that forms an opening on the radially outer limb and the bend.

6. A combustion chamber as claimed in claim 5 wherein the downstream ring structure comprises a plurality of circumferentially spaced U or V shaped portions and each U or V shaped portion having a radially inner limb extending axially upstream from the portion abutting the radially outer surface of the frame structure, a bend, and a radially outer limb extending axially downstream to the radially extending flange.

7. A combustion chamber as claimed in claim 5 wherein the radially extending flange is removably secured to a combustion chamber outer casing.

8. A combustion chamber as claimed in claim 4 wherein the downstream ring structure has an annular axially downstream extending member, the annular axially downstream extending member being arranged to form a seal with a radially outwardly extending flapper seal, the flapper seal being mounted at its radially inner end to a set of high pressure nozzle guide vanes.

9. A combustion chamber as claimed in claim 4 wherein the frame structure comprises a plurality of bosses and each boss has a corresponding one of the holes in the frame structure.

10. A combustion chamber as claimed in claim 9 wherein the frame structure includes two bosses and two holes, and the bosses are provided at corners of the frame structure.

11. A combustion chamber as claimed in claim 3 wherein the combustion chamber segments form a radially inner annular wall of the annular combustion chamber.

12. A combustion chamber as claimed in claim 11 wherein the downstream ring structure abuts a radially inner surface of the frame structure and the downstream ring structure comprises an annular radially inwardly extending flange.

13. A combustion chamber as claimed in claim 12 wherein the radially inwardly extending flange is removably located in a radially extending groove on a combustion chamber inner casing.

14. A combustion chamber as claimed in claim 11 wherein the downstream ring structure has an annular axially downstream extending member, the annular axially downstream extending member being arranged to form a seal with a radially inwardly extending flapper seal, the flapper seal being mounted at its radially outer end to a set of high pressure nozzle guide vanes.

15. A combustion chamber as claimed in claim 11 wherein the frame structure comprises a plurality of bosses and each boss has a corresponding one of the holes.

16. A combustion chamber as claimed in claim 15 wherein there are two bosses and two holes and the bosses are provided at corners of the frame structure.

17. A combustion chamber as claimed in claim 1 wherein the combustion chamber is a gas turbine engine combustion chamber.

18. A combustion chamber as claimed in claim 17 wherein the gas turbine engine is one of an aero gas turbine engine, a marine gas turbine engine, an industrial gas turbine engine, or an automotive gas turbine engine.

19. A combustion chamber as claimed in claim 1 wherein the frame structure of each combustion chamber segment comprising a first end wall, a second end wall, a first edge wall and a second edge wall, the first end wall, the second end wall, the first edge wall, and the second edge wall are integral, the frame structure of each combustion chamber segment being radially thicker and stiffer than the inner wall, the first end wall and the second end wall being thicker axially than a radial thickness of the inner wall and the first and second edge walls being thicker circumferentially than the radial thickness of the inner wall in order to carry loads and interface with adjacent combustion chamber segments and the upstream ring structure and the downstream ring structure.

20. A combustion chamber comprising an upstream ring structure, a downstream ring structure and a plurality of circumferentially arranged combustion chamber segments, the combustion chamber having an axial direction that extends axially between the upstream ring structure and the downstream ring structure, each combustion chamber segment extending along a full length of the combustion chamber, each combustion chamber segment comprising a frame structure and an inner wall, the frame structure and the inner wall being integral, each combustion chamber segment and each frame structure having an upstream end and a downstream end, the downstream end of the frame structure of each combustion chamber segment having a downstream edge and a surface, the upstream end of each combustion chamber segment being secured to the upstream ring structure and the downstream end of each combustion chamber segment being mounted on the downstream ring structure, the downstream edge of the frame structure at the downstream end of each combustion chamber segment having a circumferentially and axially upstream extending groove, the downstream ring structure having an annular axially upstream extending hook disposed in the axially upstream extending groove of each combustion chamber segment such that the hook is inserted into the groove along the axial direction, the downstream ring structure having a portion abutting the surface of the frame structure at the downstream end of each combustion chamber segment, the surface at the downstream end of the frame structure of each combustion chamber segment having a plurality of circumferentially spaced radially extending holes, the downstream ring structure having a plurality of circumferentially spaced holes extending radially through the portion abutting the surface of the frame structure, and each combustion chamber segment being removably secured to the downstream ring structure by a plurality of fasteners locatable in the holes in the frame structure and corresponding holes in the downstream ring structure, wherein the downstream ring structure includes a plurality of first holes and a plurality of second holes, the first holes and the second holes being arranged circumferentially and alternately around the downstream ring structure, each first hole having a same diameter as a diameter of the holes in the frame structure of the combustion chamber segments, each second hole being circumferentially slotted, each first hole being aligned axially and circumferentially with a hole in a corresponding combustion chamber segment and each second hole being aligned axially with another hole in the corresponding combustion chamber segment to allow relative circumferential thermal expansion between each combustion chamber segment and the downstream ring structure.

21. A combustion chamber comprising an upstream ring structure, a downstream ring structure and a plurality of circumferentially arranged combustion chamber segments, the combustion chamber having an axial direction that extends axially between the upstream ring structure and the downstream ring structure, each combustion chamber segment extending along a full length of the combustion chamber, each combustion chamber segment comprising a frame structure and an inner wall, the frame structure and the inner wall being integral, each combustion chamber segment and each frame structure having an upstream end and a downstream end, the downstream end of the frame structure of each combustion chamber segment having a downstream edge and a surface, the upstream end of each combustion chamber segment being secured to the upstream ring structure and the downstream end of each combustion chamber segment being mounted on the downstream ring structure, the downstream edge of the frame structure at the downstream end of each combustion chamber segment having a circumferentially and axially upstream extending groove, the downstream ring structure having an annular axially upstream extending hook disposed in the axially upstream extending groove of each combustion chamber segment such that the hook is inserted into the groove along the axial direction, the downstream ring structure having a portion abutting the surface of the frame structure at the downstream end of each combustion chamber segment, the surface at the downstream end of the frame structure of each combustion chamber segment having a plurality of circumferentially spaced radially extending holes, the downstream ring structure having a plurality of circumferentially spaced holes extending radially through the portion abutting the surface of the frame structure, and each combustion chamber segment being removably secured to the downstream ring structure by a plurality of fasteners locatable in the holes in the frame structure and corresponding holes in the downstream ring structure, wherein each combustion chamber segment includes a first hole associated with a corresponding hole in the downstream ring structure and each combustion chamber segment includes a second hole associated with a corresponding hole in the downstream ring structure, the first hole of each combustion chamber segment having a same diameter as the corresponding hole in the downstream ring structure and one of the second hole of each combustion chamber segment and the corresponding hole in the downstream ring structure being circumferentially slotted, the first hole of each combustion chamber segment being aligned axially and circumferentially with the corresponding hole in the downstream ring structure and the second hole of each combustion chamber segment being aligned axially with the corresponding hole in the downstream ring structure to allow relative circumferential thermal expansion between each combustion chamber segment and the downstream ring structure.

* * * * *